US012392061B2

(12) United States Patent
Gormley et al.

(10) Patent No.: US 12,392,061 B2
(45) Date of Patent: Aug. 19, 2025

(54) MANUFACTURING WOVEN TEXTILE PRODUCTS

(71) Applicant: UNSPUN, INC, San Francisco, CA (US)

(72) Inventors: Brian J. Gormley, San Francisco, CA (US); Christopher P. Meadows, Richmond, CA (US); Daniel J. Blachinsky, Squamish (CA); Ian L. Fong, San Francisco, CA (US); Nicholas L. H. Fleming, Oakland, CA (US); Miles C. D. Pekala, San Francisco, CA (US); John R. Prescott, San Francisco, CA (US); Kevin P. Martin, San Francisco, CA (US); Elizabeth Esponnette, Berkeley, CA (US); Diego Vasquez, Antioch, CA (US)

(73) Assignee: UNSPUN, INC., San Francisco, CA (US)

( * ) Notice: Subject to any disclaimer, the term of this patent is extended or adjusted under 35 U.S.C. 154(b) by 0 days.

(21) Appl. No.: 18/834,098

(22) PCT Filed: Jan. 31, 2023

(86) PCT No.: PCT/US2023/011970

§ 371 (c)(1),
(2) Date: Jul. 29, 2024

(87) PCT Pub. No.: WO2023/147164

PCT Pub. Date: Aug. 3, 2023

(65) Prior Publication Data

US 2025/0129528 A1 Apr. 24, 2025

Related U.S. Application Data

(60) Provisional application No. 63/304,944, filed on Jan. 31, 2022.

(51) Int. Cl.
*D03D 37/00* (2006.01)
*D03C 3/20* (2006.01)
(Continued)

(52) U.S. Cl.
CPC ..... *D03D 37/00* (2013.01); *D03C 3/205* (2013.01); *D03D 3/02* (2013.01); *D10B 2403/0333* (2013.01)

(58) Field of Classification Search
CPC ..... D03D 37/00; D03D 3/02; D03C 3/205; D10B 2403/0333
See application file for complete search history.

(56) References Cited

U.S. PATENT DOCUMENTS 1,362,134 A * 12/1920 Paul ..... D03D 37/00 139/34
4,361,172 A 11/1982 Torii
(Continued)

FOREIGN PATENT DOCUMENTS

CN 103498265 A 6/2000
DE 102013003439 A1 * 8/2014 ..... D03D 3/02
(Continued)

OTHER PUBLICATIONS

Extended European Search Report for European Patent Application No. 23747715.3, Oct. 18, 2024, 24 pages.

*Primary Examiner* — Robert H Muromoto, Jr.
(74) *Attorney, Agent, or Firm* — Jordan IP Law, LLC

(57) ABSTRACT

A circular loom for continuously weaving fabric with a varying diameter includes a variable diameter weaving ring, independently actuated heddles, and at least one shuttle including a weft insertion arm attached to a linear rail system configured to adjust the position of weft insertion arm based on a diameter of weaving ring. An associated method includes varying the diameter of weaving ring, indepen-
(Continued)

dently actuating heddles and adjusting the position of weft insertion arm along linear rail system to continuously produce hollow textile products having variable diameters.

23 Claims, 14 Drawing Sheets

(51) Int. Cl.
*D03D 3/02* (2006.01)
*D03D 49/00* (2006.01)

(56) References Cited

U.S. PATENT DOCUMENTS

| | | | | |
|---|---|---|---|---|
| 5,839,481 | A | 11/1998 | Bassi | |
| 2016/0281277 | A1* | 9/2016 | Esponnette | D03D 37/00 |
| 2020/0048799 | A1* | 2/2020 | Martin | D03D 3/00 |

FOREIGN PATENT DOCUMENTS

| | | | | | |
|---|---|---|---|---|---|
| JP | H0345743 | | | 2/1991 | |
| JP | H07216684 | A | * | 8/1995 | D03D 3/02 |
| JP | 2001200449 | A | * | 7/2001 | D03D 37/00 |
| JP | 3053050 | | | 1/2014 | |

* cited by examiner

MANUFACTURING WOVEN TEXTILE PRODUCTS

CROSS REFERENCE TO RELATED APPLICATIONS

This application represents the U.S. National Phase of International Application number PCT/US2023/011970 titled "Manufacturing Woven Textile Products" filed on Jan. 31, 2023, which claims the benefit of U.S. Provisional Application No. 63/304,944 titled "Manufacturing Woven Textile Products" and filed on Jan. 31, 2022, which is incorporated herein by reference.

STATEMENT REGARDING FEDERALLY SPONSORED RESEARCH OR DEVELOPMENT

This invention was made with government support under Grant Number 1831088 awarded by National Science Foundation. The government has certain rights in the invention.

TECHNICAL FIELD

The present invention is in the technical field of manufacturing woven textile products and, more particularly, to circular looms for weaving hollow textile products such as articles of clothing.

BACKGROUND

The production of textiles and garments has changed little over time. Garments are generally produced in mass quantities, stored in warehouses and then transported to clothing stores for display. Numerous different sizes of each type of garments have to be stored and displayed to fit the different sizes of the various people shopping in the clothing stores. Clothing manufacturers and sellers simply estimate how many articles of each size of clothing will be sold and produce that amount of clothing. Storage of clothing has an associated cost and when manufacturers produce the wrong amount of clothing, sales are lost due to a lack of desirable sizes of clothing and excess inventory of clothing may remain unsold. Excess inventory is often discarded in landfills or incinerated, creating substantial environmental harms.

Woven textiles have several advantages over knitted textiles. For example, woven textiles tend not to stretch out of shape. Woven textiles also tend to be thinner. In addition, woven textiles are lighter because less yarn is required to cover the same area. However, one disadvantage of woven textiles versus knitted textiles is that creating a three-dimensional final woven product generally requires stitching together several distinct woven textile pieces. For many years, manufacturers relied on producing clothing by "cut and sew" techniques. Production of woven garments involved the multi-step process of weaving raw fabric sheets, cutting the fabric sheets into panels, and sewing the panels into three-dimensional garments. Stitching two distinct woven textiles together forms a seam. Different distinct woven textiles, and thus seams, are typically needed where the product changes dimension or adds a new part.

When different pieces of fabric are cut and sewn together, a certain amount of fabric will be wasted. Often at least 15% of flat woven fabric is discarded during the cutting operation. Additionally, cutting and sewing fabrics is typically an expensive manual process. With this in mind, there is an advantage in making seamless garments in the garment manufacturing industry in order to reduce both material and labor costs, and to leverage economies of scale.

To address some of these issues, circular looms have been developed that can quickly produce clothing. For example, U.S. Patent Application Publication No. US2016/0281277, incorporated herein by reference, describes techniques for creating a three-dimensional woven textile product. The disclosed three-dimensional weaving technology can be used to create various textile products. However, current circular looms are designed to weave at a fixed output size, i.e., the looms produce woven tubes at a constant diameter. The circular looms can be re-configured to weave at different diameters, but this involves re-threading the machine and physically replacing several components. Due to this constraint, current circular looms cannot continuously weave fabric with varying diameter and circular weaving is commercially limited to constant diameter woven outputs.

U.S. Patent Application Publication No. US2020/0048799, which is also incorporated herein by reference, discloses a system and method for producing seamless woven materials that are variable in each of three dimensions. The system and method generally operate by altering heddle positions to impart three-dimensional structure to a woven fabric. Weft yarn is woven into a set of warp yarns that have been individually raised or lowered along a particular cross-section, essentially locking the weave into an intended 3-dimensional form. However, such an arrangement cannot be easily altered during manufacture. Also, such an arrangement is complex and expensive as the arrangement requires each individual heddle to have a motor and/or actuator.

Thus, there is a need for a system and method that can efficiently manufacture irregularly shaped woven fabrics with a three-dimensional structure having improved structural performance, and with reduced material. More specifically there is a need to form parts of garments that have varying diameters along their length, allowing production of various sizes on the same machine or to even fit an individual's unique body geometry. With the above in mind, in one aspect, there still exists a need in the art for a way to produce garments on-demand to eliminate waste. Direct three-dimensional weaving of complete garments or even parts of garments having a continuously varying diameter would reduce cut waste from the cutting process. Direct three-dimensional weaving of garments would also reduce waste from excess inventory. There also exists a need to eliminate waste from cutting patterns and reduce production time and other costs associated with cut and sew production.

SUMMARY OF THE INVENTION

The present invention is directed to a system and method for continuously weaving fabric products such as clothing, textiles, or even diverse items such as composite structures, inflatable structures, medical devices, fire hoses or bags, having a varying diameter. The weaving is conducted with a loom comprising a variable diameter weaving ring having a diameter that is altered during production of the clothing. Individual heddles are assembled in groups to form heddle units. Independently actuated heddle units are employed to further control the weaving process. Each of the heddle units includes an actuator for moving the heddle units. Alternatively, the heddle units are driven with a mechanical cam or linkage system. The heddle units are modular, and each heddle unit can be replaced as needed for repair or other reasons. Shuttles are provided with a bobbin to support a weft yarn and a weft insertion arm attached to each shuttle.

In order to compensate for the varying size of the weaving ring, the weft insertion arm is configured to move radially inward and outward in response to the changing diameter of the weaving ring. An adjusting unit or system is configured to adjust the position of the weft insertion arm. The system includes a linear rail for supporting the insertion arm and an actuator to move the weft insertion arm along the rail. One end of the arm is supported on the shuttle and the other end of the arm supports an eyelet. The weft extends from the bobbin to a sensor that detects weft breakage. The weft yarn extends through the sensor to the eyelet in the insertion arm. This arrangement allows for the weft to be inserted where the warp yarns meet the weaving ring and provides for improved continuously variable weaving. Preferably the sensor is a spring biased mechanism that supports the weft yarn. The weft applies pressure against the spring biased mechanism in the sensor. If the weft yarn breaks, the spring biased mechanism rotates and activates the sensor.

In alternate embodiments, the weft insertion arm preferably moves in non-radial and/or at least non-linear trajectories. For example, combinations of revolute joints can be used to accomplish similar desired motion profiles. There are various straight-line mechanisms which may be employed to accomplish these goals. In these alternate embodiments, the weft insertion point, i.e., the tip of the insertion arm, still moves in an effectively radial manner, but the arm itself may take another trajectory.

In combination with the adjustment of the weaving ring, the heddle units must dynamically change weave patterns to accommodate varying weave diameters. Each time a weft line crosses a warp line, an incremental amount of fabric length is added to the total circumference of the woven output. By alternating the weave pattern of the heddle units, the number of weft crossings can be altered in a manner that reduces the total circumference of the woven output in coordination with the adjustment of the weaving ring. Common weave patterns include 2×1 twill, 3×1 twill, and 4×2 twill, although any arbitrary arrangement of warp lines is possible. Specifically, 2×1 twill weaves, which have more weft crossings, are appropriate for larger diameter outputs, 3×1 twill weaves, with fewer weft crossings, are appropriate for medium diameter outputs, and 4×2 twill weaves, with even fewer weft crossings, are appropriate for small diameter outputs.

The variable diameter weaving ring is preferably made of a flexible nylon band. A portion of the flexible band is placed in a circle to form the variable diameter weaving ring, while another portion of the flexible band extends beyond the ring and is stored on a take-up mechanism. Preferably, the loom has a plurality of support arms for supporting the variable diameter weaving ring. Each arm includes a pivotably mounted guide configured to slidably support the variable diameter weaving ring. More specifically, each guide preferably includes two fingers configured to support the variable diameter weaving ring slidably therebetween. Other support configurations are also preferred, including rollers, hybrid roller-finger tongs, and single finger tongs. The diameter of the weaving ring is increased by moving the support arms radially outward and moving some of the flexible band from the take-up mechanism. The arms are mounted for synchronous motion so as to allow the arms to move radially outward at the same time and to ensure the weaving ring maintains a circular shape as the ring expands its diameter.

In operation, warp yarns are pulled off storage bobbins and brought to the heddles. The heddles are individually actuated to control the warp yarns as the warp yarns are weaved with the weft yarns. The warp yarns are switched by the heddles from an upper position to a lower position. The line the warp yarns follow, from the heddles in the upper position to the weaving ring and the line the warp yarns follow from the heddles in the lower position to the weaving ring, define a warp shed. During weaving the shuttles bring the weft yarn through the warp shed and the heddles switch between upper and lower positions, thus causing the weft yarn to be woven into the warp yarns. Continuously weaving fabric with the circular loom includes varying the diameter of the weaving ring, while moving the support arms and changing the heddle weave pattern in a synchronous manner, and moving part of the flexible material that forms the ring to or from the take-up mechanism. As indicated above, to compensate for the changing diameter for the weaving ring, weaving also includes adjusting the position of the weft insertion arm along the linear rail system on each shuttle.

This overall approach allows for the continuous weaving of fabric whose diameter varies along the length of the output, thereby enabling the direct weaving of garment components (i.e., single pant legs, shirt sleeves, dresses, etc.). The system can also be used to produce bifurcated outputs which would allow for the direct weaving of complete garments. This approach to textile manufacturing is analogous to 3D printing.

Additional objects, features and advantages of the present invention will become more readily apparent from the following detailed description of preferred embodiments when taken in conjunction with the drawings wherein like reference numerals refer to corresponding parts in the several views.

BRIEF DESCRIPTION OF THE DRAWINGS

The disclosure may be more completely understood in consideration of the following description of various illustrative embodiments in connection with the accompanying drawings.

DETAILED DESCRIPTION OF PREFERRED EMBODIMENTS

Figure 1:
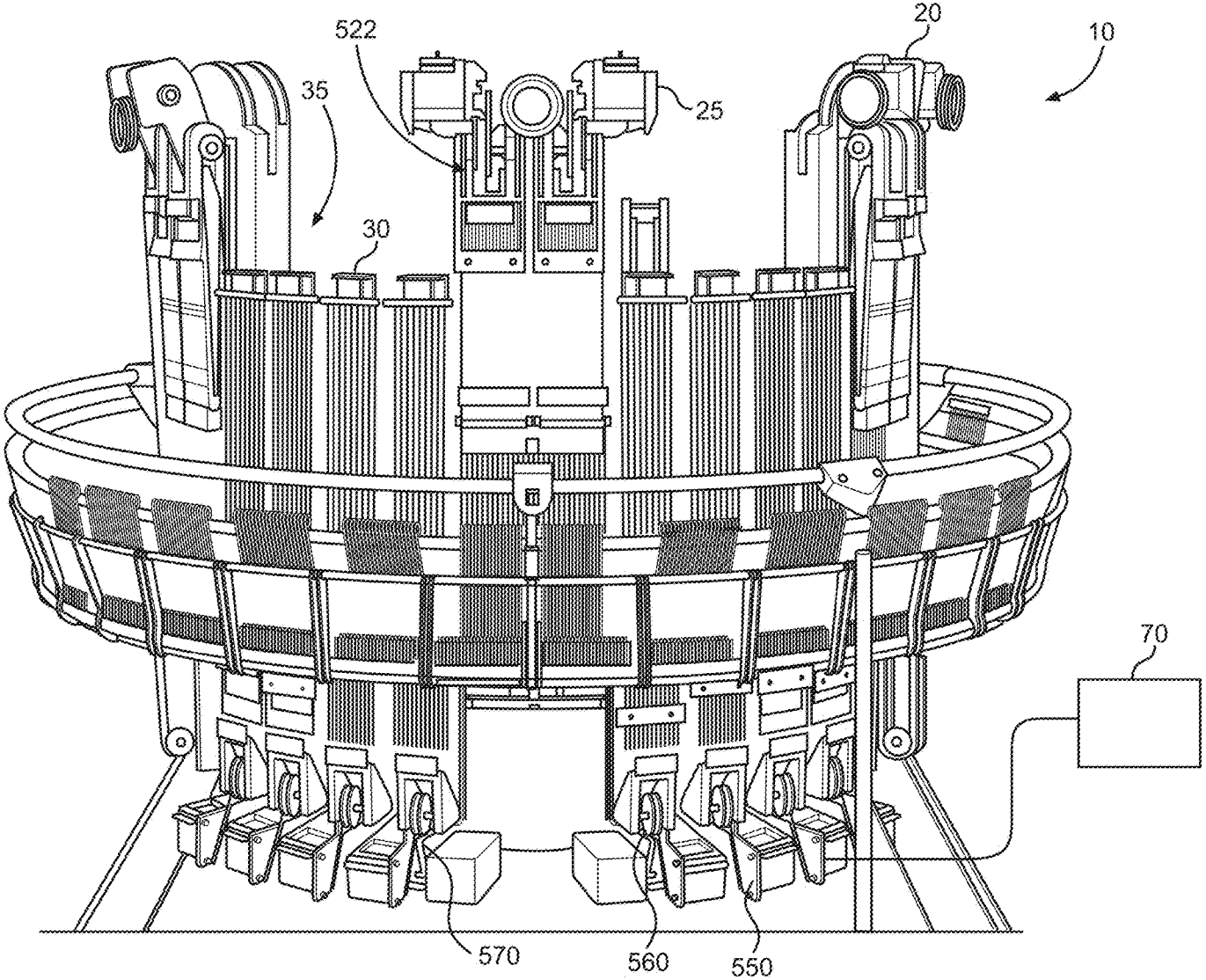
FIG. 1 is a perspective view of a loom in accordance with a preferred embodiment of the invention.

The following detailed description should be read with reference to the drawings in which similar elements in different drawings are numbered the same. The detailed description and the drawings, which are not necessarily to scale, depict illustrative embodiments and are not intended to limit the scope of the disclosure. Instead, the illustrative embodiments depicted are intended only as exemplary. Selected features of any illustrative embodiment may be incorporated into another embodiment unless clearly stated to the contrary. While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents and alternatives falling within the spirit and scope of the disclosure.

Definitions

As used throughout this application, the singular forms "a", "an" and "the" include plural forms unless the content clearly dictates otherwise. In addition, the term "or" is generally employed in its sense including "and/or" unless the content clearly dictates otherwise.

"Yarn" refers to any string-like input to the weaving process. Yarn is a generic term for a continuous strand of textile fibers, filaments, or material in a form suitable for knitting, weaving, braiding, or otherwise intertwining to form a textile fabric and is often used interchangeably with "threads" and "lines."

"Weave" refers to a system, or pattern of intersecting warp and filling yarns. The term, "Weave", is used to describe a large area of textiles that are not knitted or are non-woven fabrics. Plain, twill, and satin are all types of weaves.

"Weft and warp" are terms that refer to the constituent yarns within a weave. The warp yarns run longitudinally to the direction of production while the weft yards run latitudinally to the direction of production and are sometimes called "filling yarns".

"Threads per inch" is a measure of density of a fabric.

"Ends per inch" (EPI) is a similar measurement used when looking at the warp yarns while "picks per inch" (PPI) is used when looking at the weft yarn.

"Heddles" refers to structures usually shaped as a loop or eyelet that is able to control the movement (shedding) of the warp yarns. The specific construction of a heddle can vary within different machines.

"Shed" refers to a temporary separation between upper and lower warp yarns and is often used interchangeably with "warp shed." A warp shed is also a triangularly shaped opening formed in the warp lines as the heddles move. The term also is often used as a verb to describe the action of the upper and lower warp yarns switching positions.

A "shuttle" is a movable loom component that acts as a carriage for the weft line and travels through the warp shed to deposit the weft line.

"Weft insertion" refers to the act of inserting weft into a weave usually via a shuttle with a weft bobbin.

"Weft insertion point" refers to a point set radial distance away from the weaving ring, where the weft is deposited.

"Crimp" refers to the waviness of a fiber. More specifically, crimp is the measure of the degree of waviness present in the yarns inside a woven fabric due to interlacement.

"Cover factor" refers to the ratio of area covered by the yarns to the total area of the fabric.

Overview

FIG. 1 shows a perspective view of a loom 10 in accordance with a first preferred embodiment of the invention. Loom 10 is a circular loom which can be thought of as a series of flat looms arranged in a circle. The operating principles are generally the same as a flat loom, with the major difference lying in the continuous travel of one or more shuttles 15, one of which is labelled in FIG. 2, which depicts a top view of loom 10. Loom 10 has six shuttles, of which four are shown. Loom 10 may have as few as one shuttle and may have as many as can physically fit within the diameter of loom 10, however, six is preferable. Due to the circular shape of loom 10, during operation, shuttles 15 will pass by heddle units 20. As one of shuttles 15 exits a warp shed of one of heddle units 20, the shuttle will enter the warp shed of an adjacent heddle unit. Some of heddle units 20 are upright (such as at 25) while some are positioned upside down (such as at 30). Upside down heddle units 30 provide a space 35 for an operator to access an inner portion of loom 10. While not shown in FIG. 1, all heddle units 20 could be mounted upside down and such an arrangement is considered preferable. Heddle units 20 are adjustable. Although not shown in FIG. 1, a supply of yarn is provided to heddle units 20 during operation of loom 10.

Figure 2:
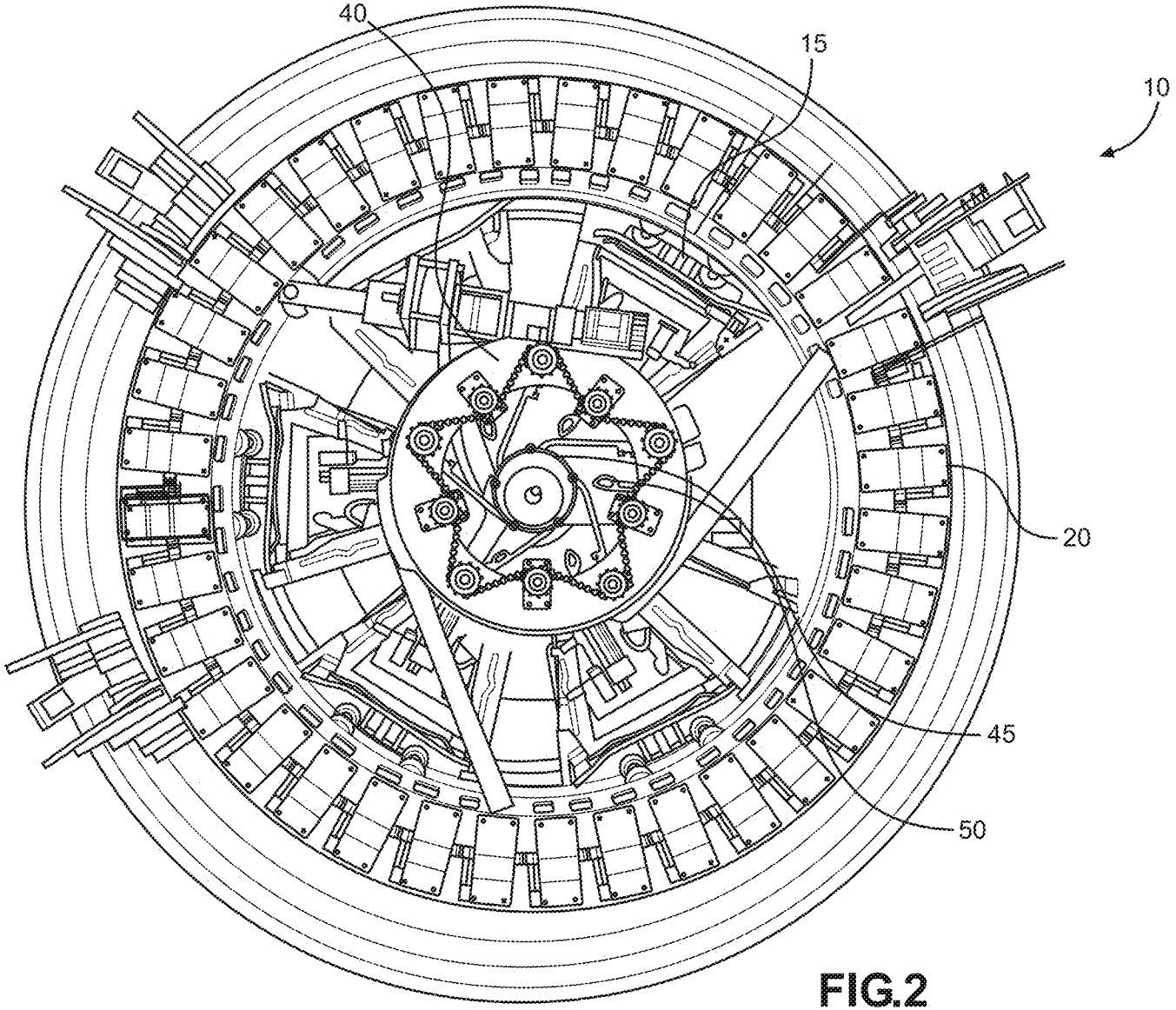
FIG. 2 is a top view of the loom shown in FIG. 1.

With reference to FIGS. 1 and 2, loom 10 includes a variable diameter weaving ring 45 (FIG. 2) and a plurality of variable position weft insertion arms 50 with one arm being positioned on each shuttle 15. Loom 10 includes a system of individually actuated heddle units 20 all controlled by a heddle control board 522 (FIG. 1). Preferably loom 10 has 36 individually actuated heddle units 20 and each heddle unit has twenty individual heddles of which only eighteen are used during weaving. However, if loom 10 is made larger many more heddle units would preferably be provided and there also may be more heddles per unit. Preferably, loom 10 has six weft insertion shuttles 15, four of which are shown in FIG. 2, and one variable diameter weaving ring 45.

Variable Diameter Weaving Ring

Figure 3:
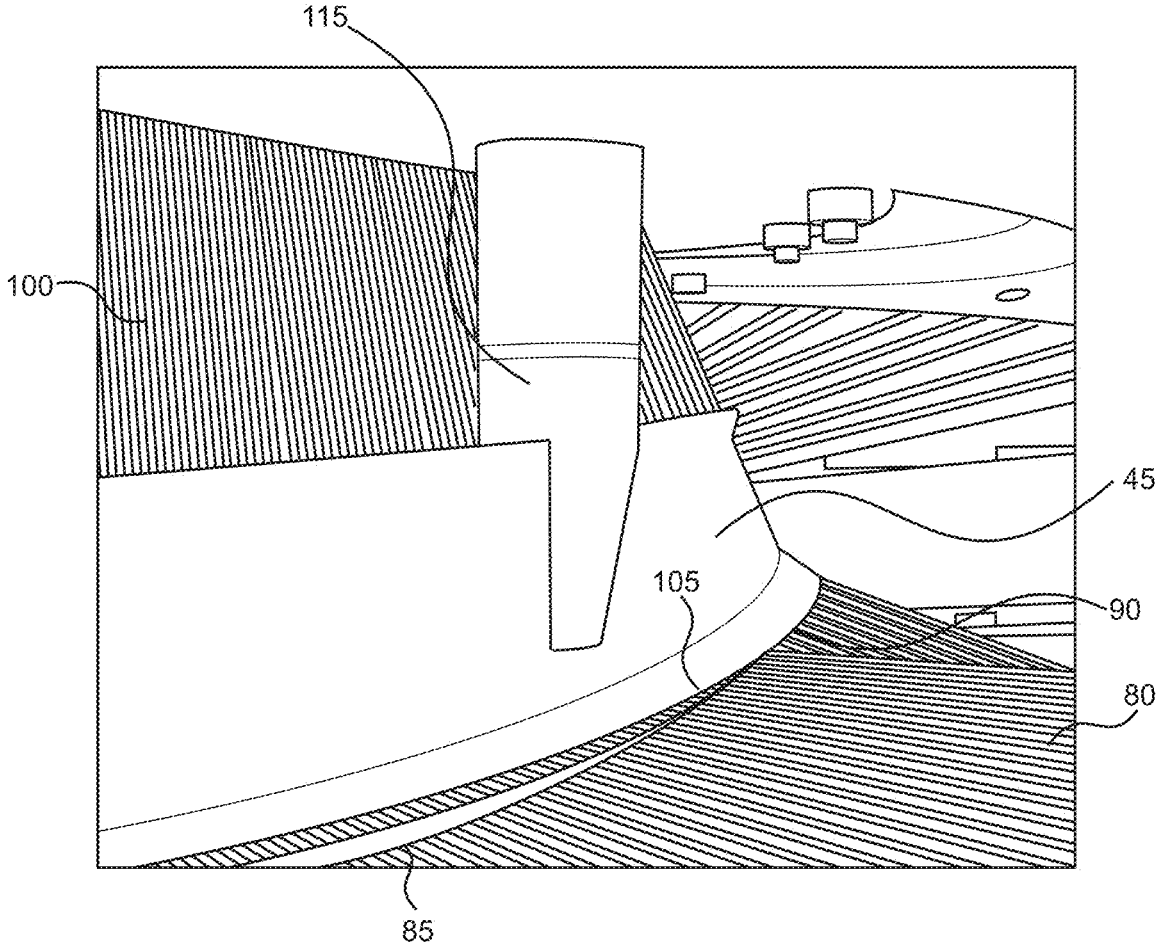
FIG. 3 shows a close-up view of an adjustable weaving ring from the loom of FIG. 1.

Turning now to FIG. 3, variable diameter weaving ring 45 is located where warp lines 80 meet weft lines 85 to form a weft insertion point 90 to create a fabric product 100. A fell line 105, which is the edge of the weaving where the last weft line 85 was placed, is an interface where unwoven warp lines 80 become woven fabric product 100 when interlaced with weft line 85. Preferably, the bottom of the weaving surface of weaving ring 45 is continuous and smooth so as to avoid tangled or breakage of warp lines 80 during weaving. A set of support guides 115 supports weaving ring 45.

Figure 4:
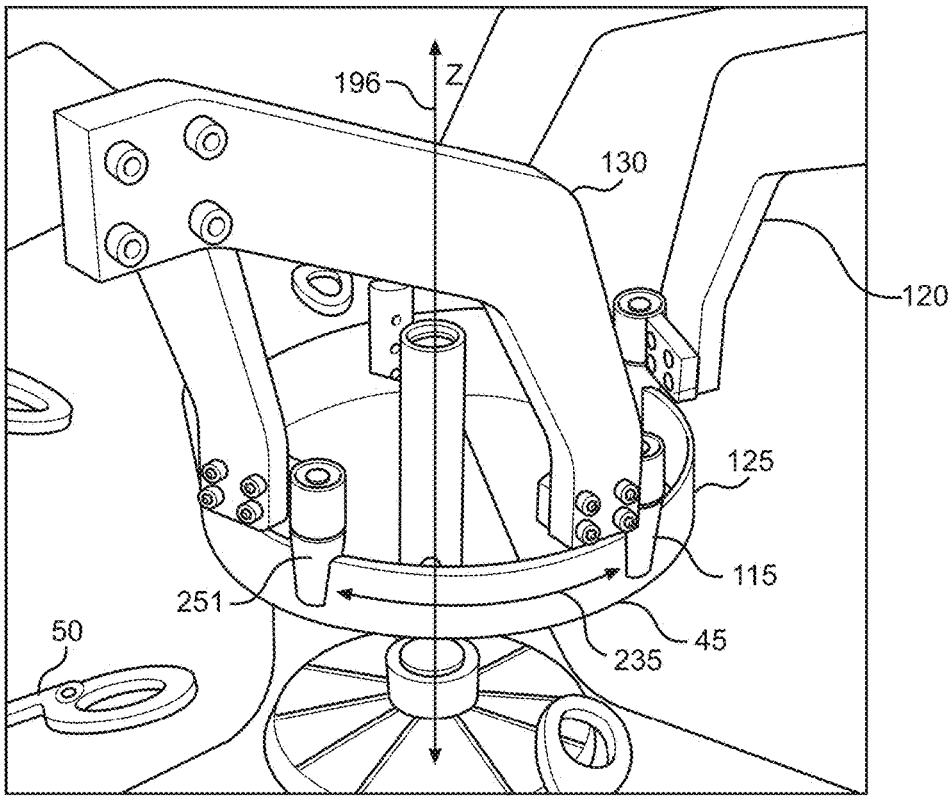
FIG. 4 is an upper perspective view of support arms holding the weaving ring of FIG. 3.
Figure 5:
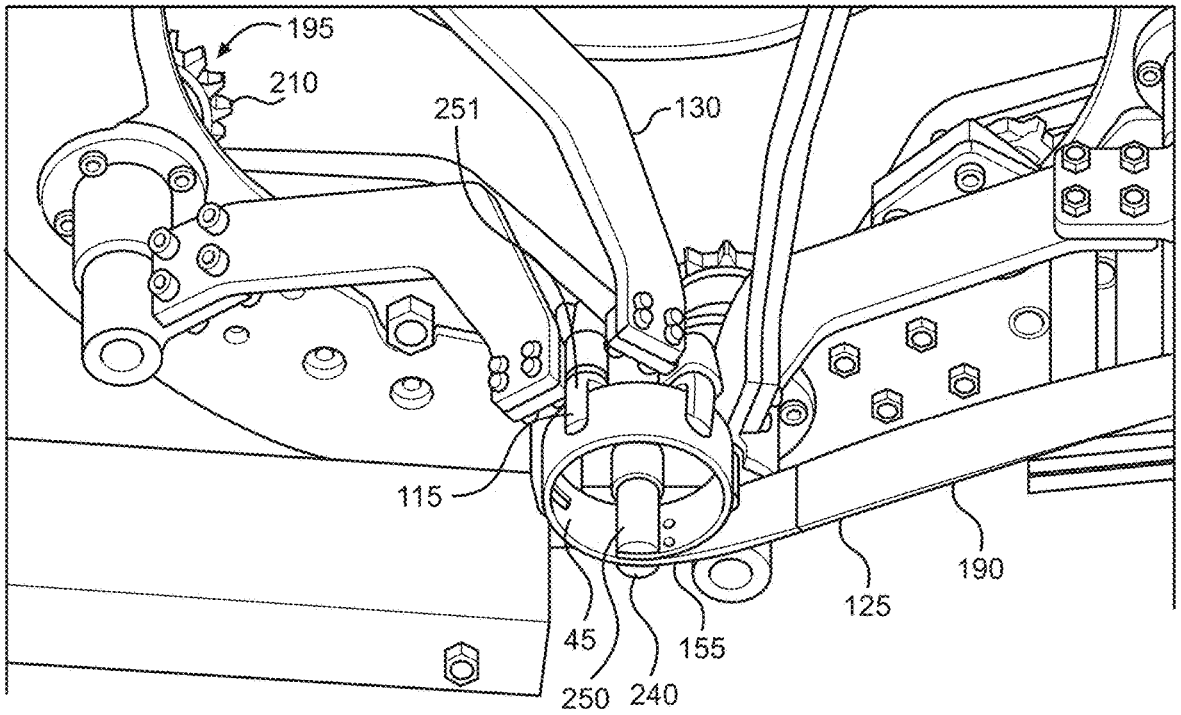
FIG. 5 is a lower perspective view of the support arms holding the weaving ring of FIG. 3.

As best seen in FIGS. 4 and 5, variable diameter weaving ring 45 is formed as part of a flexible band 125 supported by five guides 115. A plurality of support arms 130 support guides 115. Flexible band 125, which could also be described as semirigid, creates a continuous weaving surface. Flexible band 125 overlaps itself at one overlap point or location 155 and the overlap of excess band material 190 becomes more or less as the circle formed by flexible band 125 grows larger or smaller.

Support arms 130 move in synchronism to achieve a proper weaving action. A chain drive 195 (see FIGS. 6 and 7) guarantees synchronous motion between all of support arms 130 and helps maintain a circular output that is always centered around an output axis 196 in the Z direction of loom 10. While chain drive transmission 195 is a preferred synchronizing mechanism, other options are possible. For example, timing belts, ring gears, cam mechanisms and other linkages could also be employed. If a non-circular output for fabric product 100 is desired, for example, an oblong or elliptical output, or an output that is not centered around output axis 196, support arms 130 can be individually actuated. However, loom 10, as shown, is set up to produce a circular fabric product 100. Therefore, support arms 130 are shown coupled together using a chain 200 which engages with sprockets 210 of chain drive transmission 195, as seen in FIGS. 5, 6 and 7.

Support arms 130 passively follow the shape of flexible band 125. Support arms 130 function to provide support along output axis 196 of loom 10. Alternatively, support arms 130 may be moved with either a single actuator moving all of support arms 130 or each arm could be fitted with an individual actuator. Each arm of support arms 130 is preferably provided with a joint encoder 230 (FIG. 6) for indicating the angular position of a respective arm. However, loom 10 can be made to function with only one joint encoder on a single support arm. Support arms 130 continuously provide support for flexible band 125 along output axis 196 as flexible band 125 forms weaving ring 45 that changes diameter. The number of support arms 130 required is dependent on the maximum unsupported band length 235 (FIG. 4) that a given band material can support before buckling. If there are just a few support arms 130 unsupported band length 235 increases. Unsupported band length 235 also increases when the diameter of weaving ring 45 increases. Preferably, there are five support arms 130, but fewer can be used. The use of fewer supports limits the maximum weaving ring diameter before increasing unsupported length 235 (FIG. 4) leads to failure. More support arms 130 could be used, but that would limit the smallest weaving ring diameter before support arms 130 interfere with one another. However, for large weaving ring diameters more than five support arms are preferable and if material with greater flexibility is employed for the flexible band, more support arms would be needed to reduce the unsupported band length. Support arms 130 are preferably arranged normal to weaving ring 45. One of support arms 130 holds a joiner guide 240 (FIG. 5) where excess band material 190 leaves weaving ring 45. Alternatively, support arms 130 could be tangent to weaving ring 45, specifically when weaving ring 45 is at its smallest diameter. The advantage is that band 125 converges at a central location that can be the position for a winder mechanism, described below.

As best shown in FIGS. 4 and 5, guides 115 holding flexible band 125 in a circular configuration help form weaving ring 45. Preferably, guides 115 have inner fingers 250 and outer fingers 251 that hold weaving ring 45 therebetween. Guides 115 are pivotally mounted on support arms 130. Flexible band 125 slides through guide guides 115 as support arms 130 change position when more or less of flexible band 125 is fed into weaving ring 45. Guides 115 are preferably made of aluminum and a low friction surface contact between the aluminum guides 115 and variable diameter weaving ring 45 allows for relative motion between guides 115 and flexible band 125. Alternatively, a rolling connection, not shown, could be used between guides 115 and flexible band 125.

Figure 6:
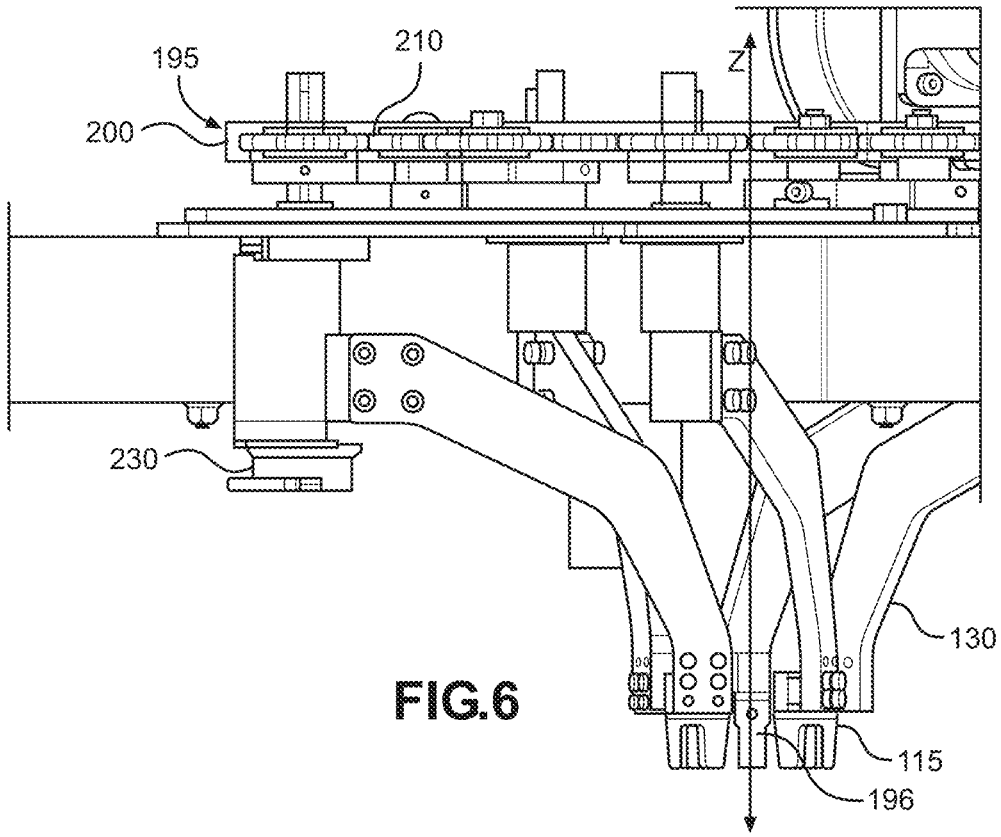
FIG. 6 shows the support arms of FIGS. 4 and 5 being connected to a synchronizing mechanism.
Figure 7:
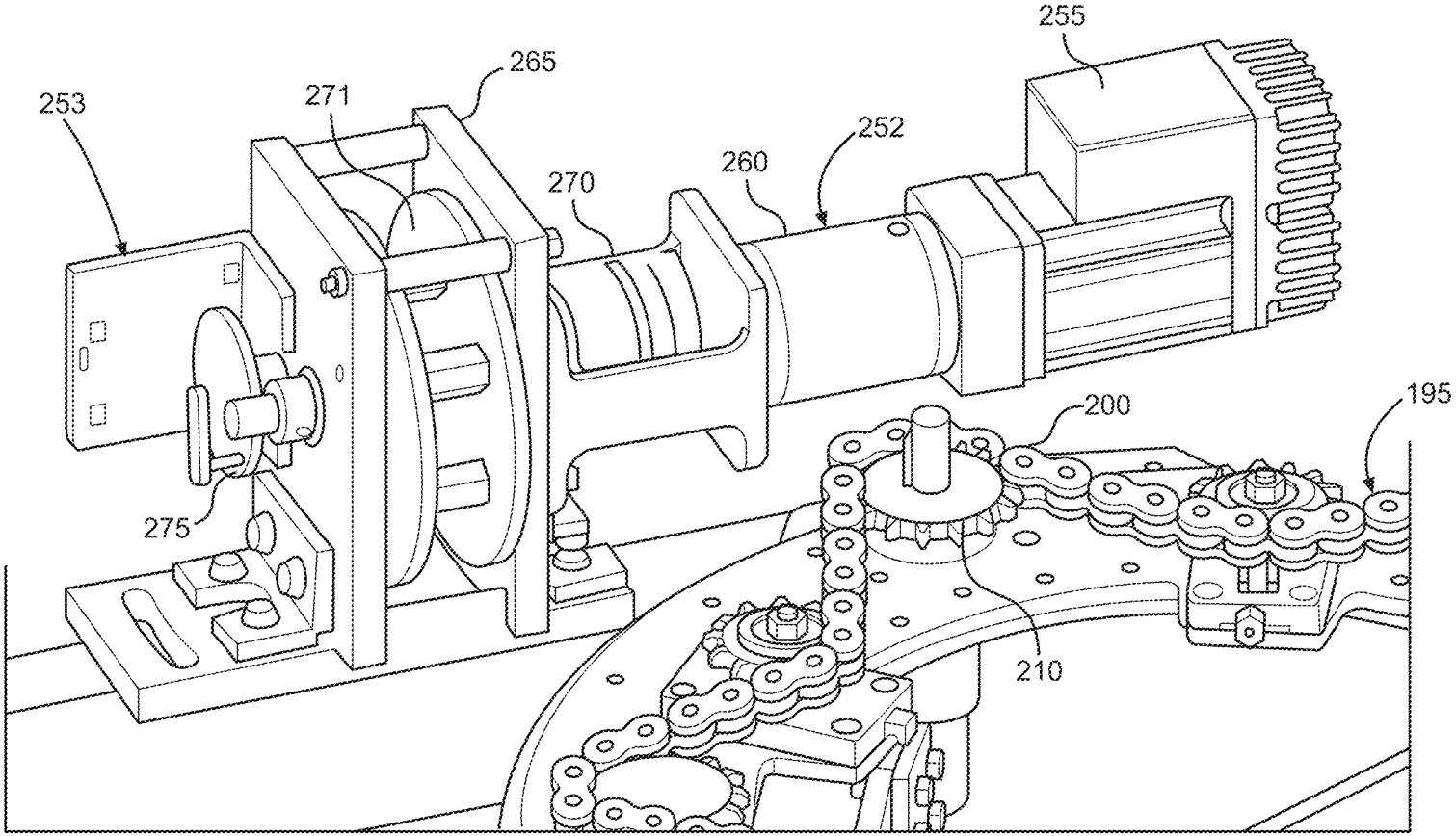
FIG. 7 shows a take-up mechanism for storing excess portions of a flexible band forming the weaving ring.
Figure 10:
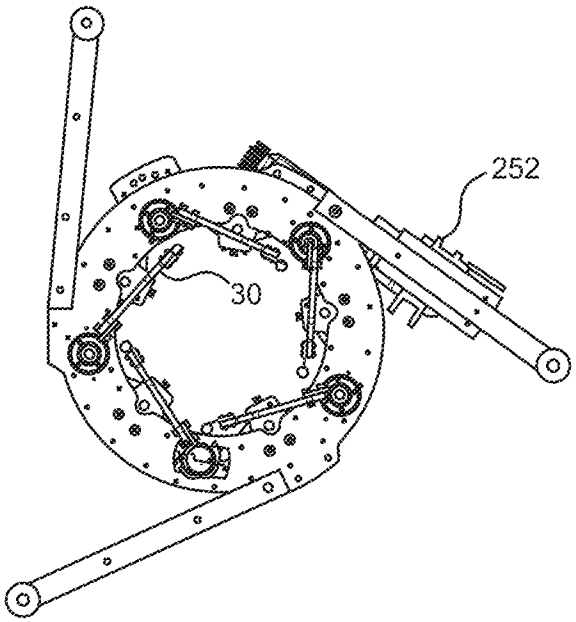
FIGS. 8-10 show the support arms progressively retracting to accommodate an expanding weaving ring.
Figure 9:
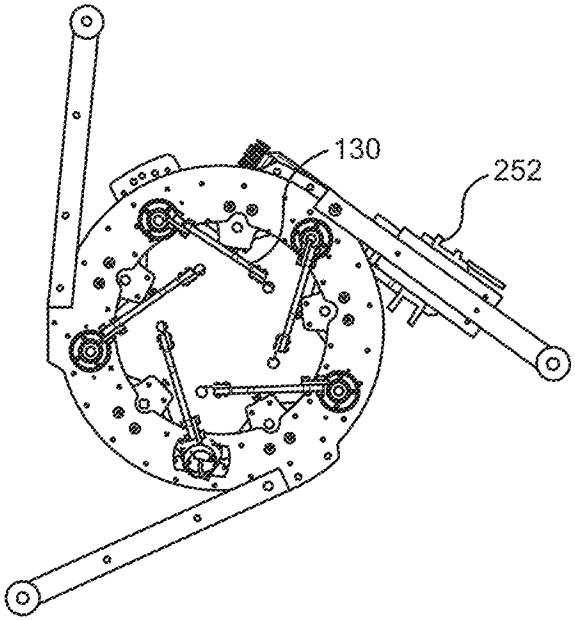
Figure 8:
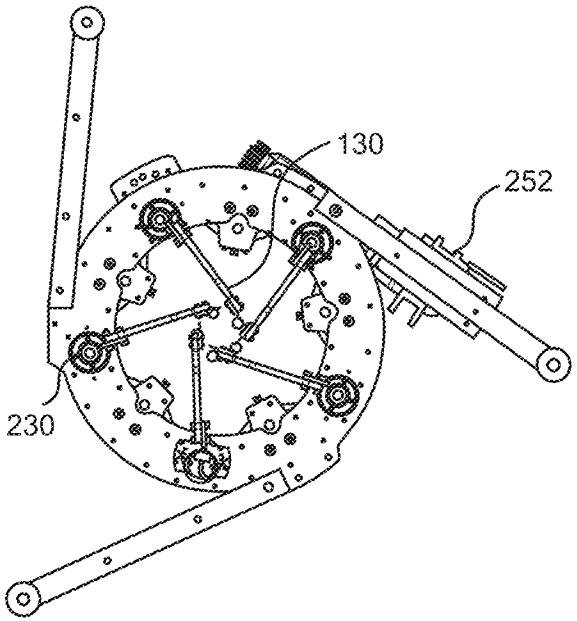

As shown in FIGS. 4-7, to adjust the diameter of the variable diameter weaving ring 45, a desired command is sent by the control system 70 to weaving ring control board 253. The desired command could be in the form of a single command, or a sequence of commands representing an entire weave. The weaving ring control board 253 then sends commands to a motorized winder 252, which is provided to take in or let out calculated quantities of excess band material 190 (FIG. 5) as needed. A motor 255 powers take-up winder 252 (FIG. 7). Motor 255 rotates a gear reduction unit 260 which is connected to a pulley 265 by a coupling 270. Pulley 265 is provided with a wheel 271 that stores excess flexible band material 190 (not shown in FIG. 7) and pays out excess band material 190 as needed. A pulley encoder 275 senses the position of pulley wheel 271 and provides a signal which is used to determine how much of flexible band 190 has been dispensed. The size of the circle formed by flexible band 190, i.e., the size of variable diameter weaving ring 45 can be measured directly or the diameter can be calculated by measuring the angular measurement of support arms 130 with arm encoders 230 (FIG. 6). Support arms 130 are shown at a fully extended position in FIG. 8, corresponding to the smallest diameter for weaving ring 45; a middle position in FIG. 9, corresponding to an intermediate diameter for weaving ring 45 and a retracted position in FIG. 10, corresponding to a largest diameter for ring 45. Variable diameter weaving ring 45 is designed so as not to interfere with warp shed 231, shown in FIG. 11, while still allowing operator access to the warp yarn lines 80 and weaving weft yarn lines 85.

The flexible band forming weaving ring 45 must be stiff enough to withstand lateral torsional buckling, but flexible enough in the length axis to allow for bending. More specifically, variable diameter weaving ring 45 is stiff enough to avoid lateral torsional buckling under loading of warp lines 80 yet is flexible enough to curl into small diameters around output axis 196 (FIG. 4) to create small diameter fabric product 100 as shown in FIG. 3. Preferably the band is made of a polymer and, more preferably, Nylon 6/6 or another polymer, metal or composite material with a similar desirable combination of stiffness, strength, and frictional properties.

To synchronize the motion of the weaving ring 45 and the weft shuttle, loom 10 is equipped with one or more sensors configured to directly detect the presence of one or more shuttles at a known angular position within loom 10. In one embodiment, the shuttles may be equipped with a magnet, which is detected by a stationary magnetic sensor placed on the periphery of loom 10. The detection of a shuttle by the magnetic sensor is communicated to weaving ring control board 253 via synchronization control signal 72, which upon receiving communication, may choose to perform a desired command.

Weft Insertion Arm

Figure 12:
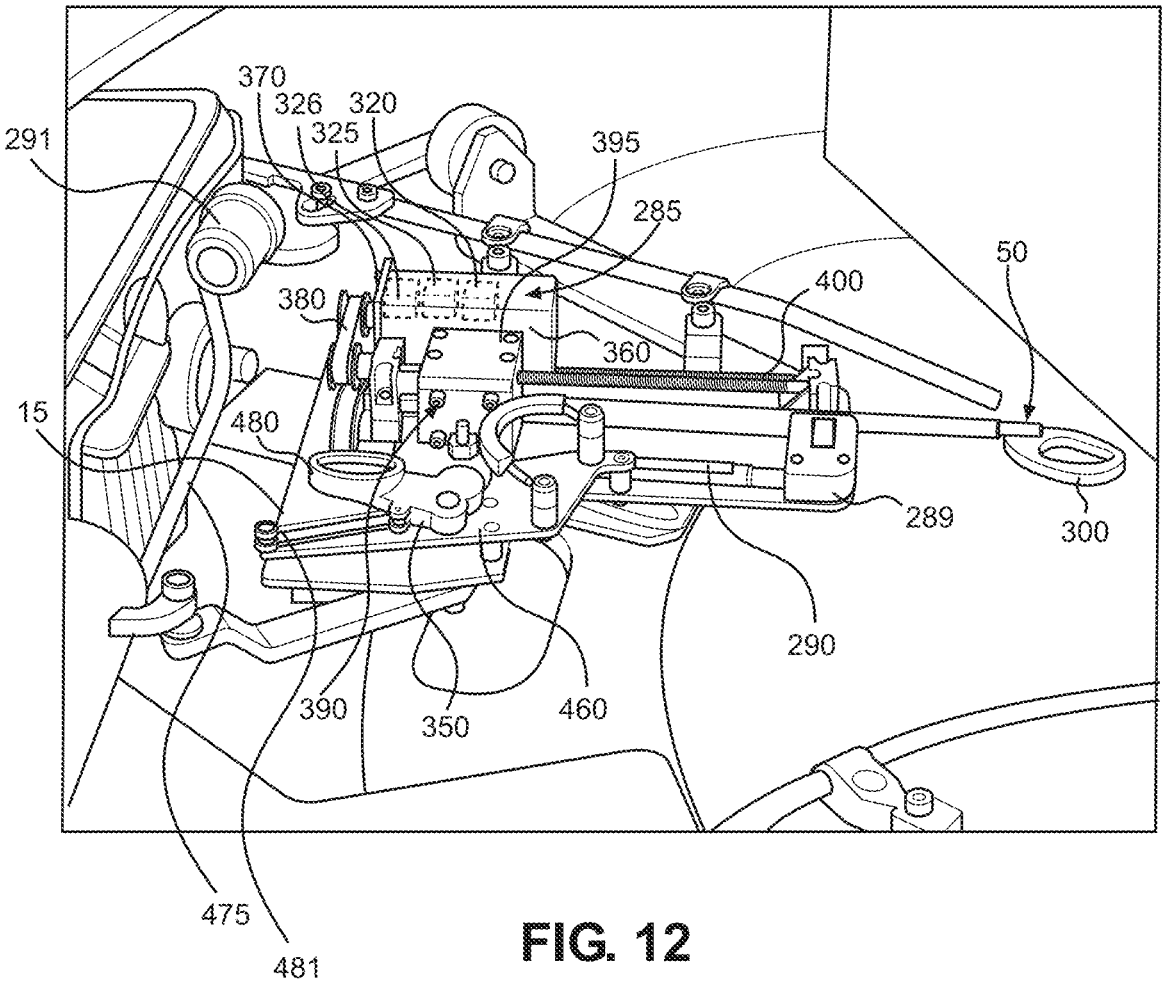
FIG. 12 is a close-up view of a shuttle from the loom of FIG. 1 and shows details of an insertion arm.

FIG. 12 shows a close-up view of one of weft shuttles 15 from FIG. 2. In a most preferred configuration, loom 10 varies the radial location of weft insertion arm 50, which passes through a linear guide or rail system 289 placed at the end of linear actuator 285 to support insertion arm 50 from side loading and to protect linear actuator 285 from binding. Weft insertion arm 50 receives weft yarn 85 (FIG. 3). The location is moved by the linear actuator 285 that responds to a position sensor 290, which is preferably a flexible potentiometer. Weft insertion arm 50 is preferably mounted on a shuttle 15. Weft bobbin 291, supporting weft yarn not shown, rotates about an axis defined on shuttle 15. The weft yarn travels through an electromechanical weft break sensor 350 to an insertion finger 300 connected to the linear actuator 285, where the weft is placed/inserted near variable weaving ring 45 and incorporated into the weave forming fabric product 100 as best seen in FIG. 3. An onboard battery 320 powers the onboard shuttle control board or controller 325, which controls linear actuator 285 and receives feedback from both linear position sensor 290 and weft break sensor 350. Onboard shuttle control board 325 also communicates with loom control system 70 (FIG. 1) via a wireless signal. A stepper motor 360 with an integrated encoder 370 transmits radial motion through a 1 to 1 belt drive system 380 to a lead screw drive assembly 390, which translates the radial motion of belt drive system 380 to linear motion via a carriage 395 on a leadscrew 400. Loom 10 also actively monitors for weft breaks via weft break sensor 350.

Referring back to FIGS. 2 and 3, as variable diameter weaving ring 45 changes diameter, insertion point 90 located near the end of arm 50, is varied to ensure the correct length of weft yarn 85 is deposited and the correct tension is applied. Positional feedback from linear position sensor 290, shown in FIG. 12, to shuttle control board 325 and is used to actively check the position of insertion arm 50 as it travels the entire distance of linear actuator 285.

Figure 18:
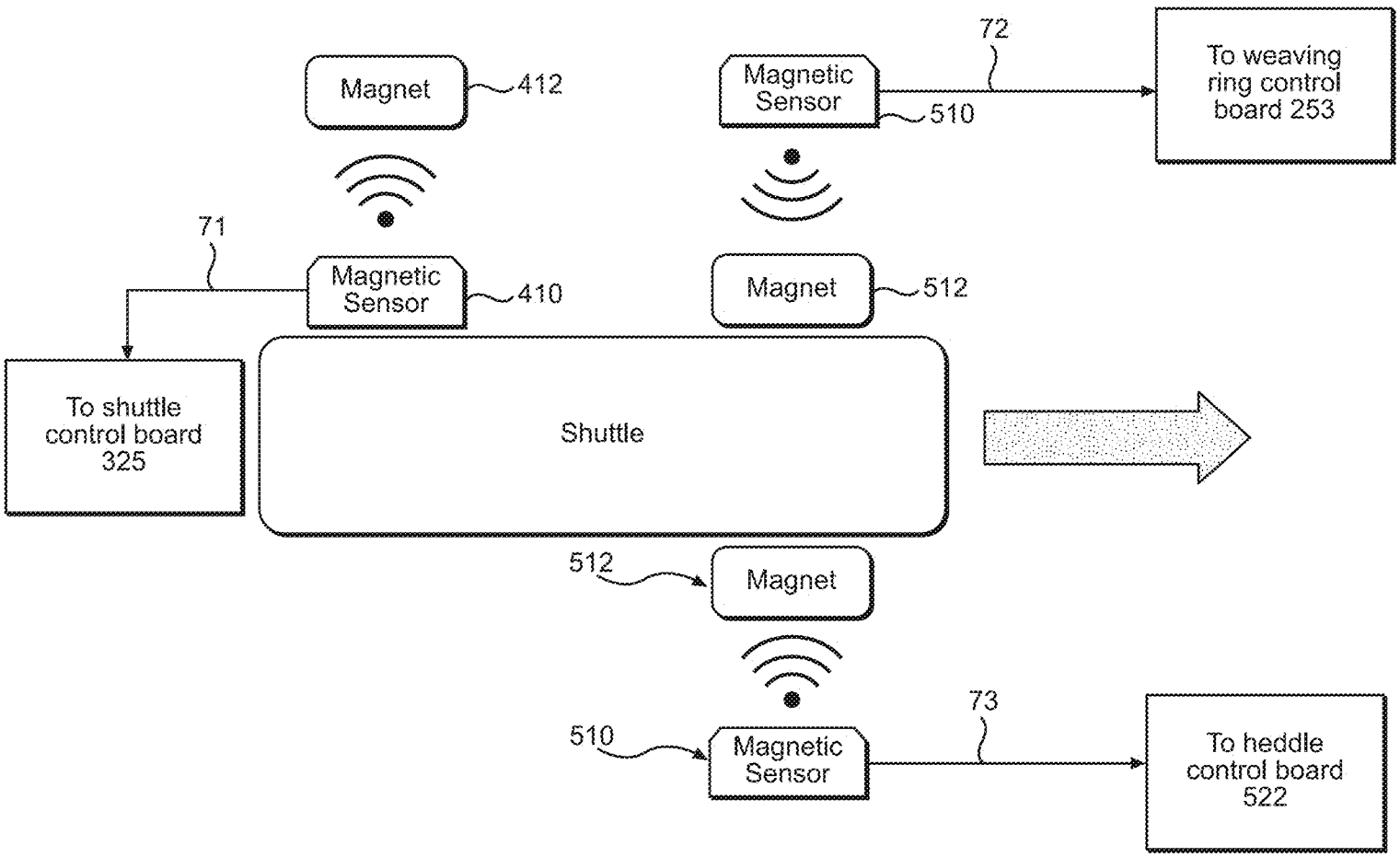
FIG. 18 shows an arrangement of magnetic sensors used for synchronizing the weaving ring, heddles, and shuttle.

As best seen in FIG. 18, to synchronize the motion of weft insertion arm 50 and weaving ring 45, shuttle 15 is equipped with one or more sensors configured to directly detect the presence of one or more landmarks at a known angular position within loom 10. In one embodiment, shuttles 15 may be equipped with a magnetic sensor 410, which detects a stationary magnet 412 placed on the periphery of loom 10. The detection of magnet 412 by magnetic sensor 410 is communicated to shuttle control board 325 via synchronization control signal 71, which upon receiving communication, may choose to perform a desired command. In a similar manner, sensor 510 provides synchronization control signals 72, 73 to control boards 253 and 522, respectively.

Weft Break Sensor

Referring back to FIG. 12, weft break sensor 350 includes a magnetic hall sensor 460 and series of ceramic components. Weft yarn, not shown, will be routed through three contact points. The first contact point is a fixed ceramic element 475 over which the weft is routed. The second contact point is a spring loaded, ceramic eyelet 480 biased with a spring 481, which has one degree of rotational freedom. The weft yarn is routed through eyelet 480. The third contact point is the ceramic insertion finger 300. When the weft breaks, the spring loaded, ceramic eyelet 480 rotates to reveal a magnet above a magnetic hall sensor 460. Sensor 460 sends a digital signal to shuttle control board 325.

Electronic Control

As seen in FIG. 12, shuttle control board 325 is powered by battery 320. For example, a commercially available 6s LiPo battery could be used. Shuttle control board 325 is a specialized control board. A wireless communication board 326 is a separate wireless connectivity module that receives signals from main control system 70 of loom 10 (FIG. 1). The wireless communication board 326 can operate using different technologies, including but not limited to WiFi, Bluetooth, Zigbee, or radio. Wireless communication board 326 is connected to shuttle control board 325 via wired connection and relays commands from main control system 70 to shuttle control board 325. Shuttle control board 325 can check for commands and report errors. Shuttle control board 325 preferably uses Modbus, which is a communication protocol that allows for communication between programmable logic controllers. However, other communication protocols could also be employed. The communication protocol is preferably used to allow shuttle control board 325 to communicate with linear actuator 285 as well as the wireless modem. Shuttle control board 325 receives digital signals from weft break sensor 350 and analog signals from linear position sensor 290. The battery charge is monitored by shuttle control board 325.

The Heddles

Figures 13, 14:
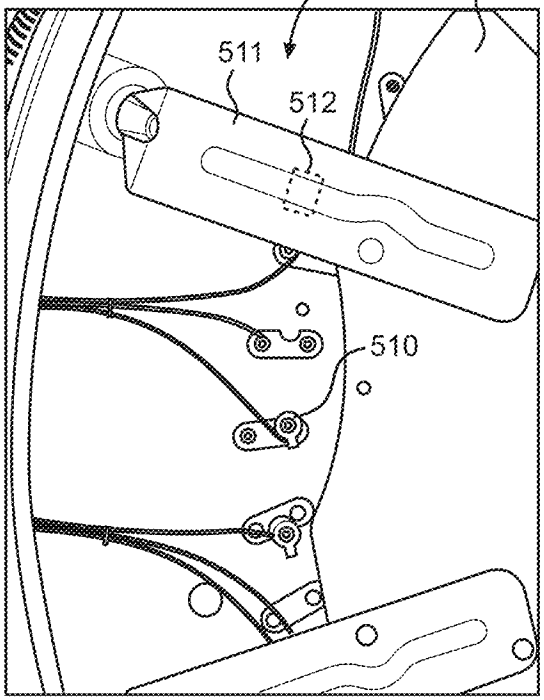
FIG. 13 is a top view of synchronization sensors for controlling the heddles of the loom in FIG. 1.
FIG. 14 is a perspective view of the sensors of FIG. 13.
Figure 16:
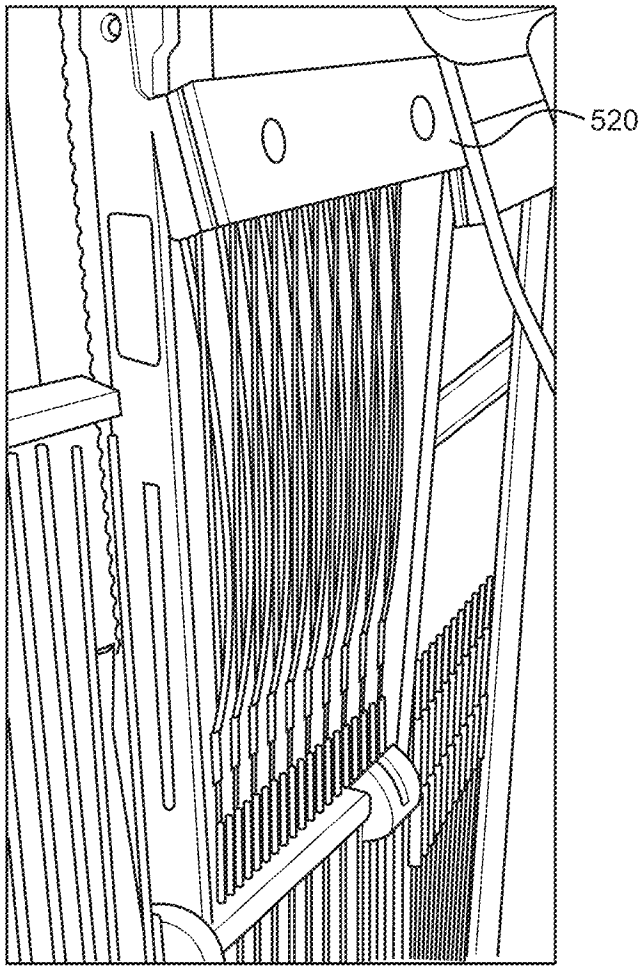
FIGS. 15 and 16 show a detailed view of a heddle unit of the loom shown in FIG. 1.
Figure 15:
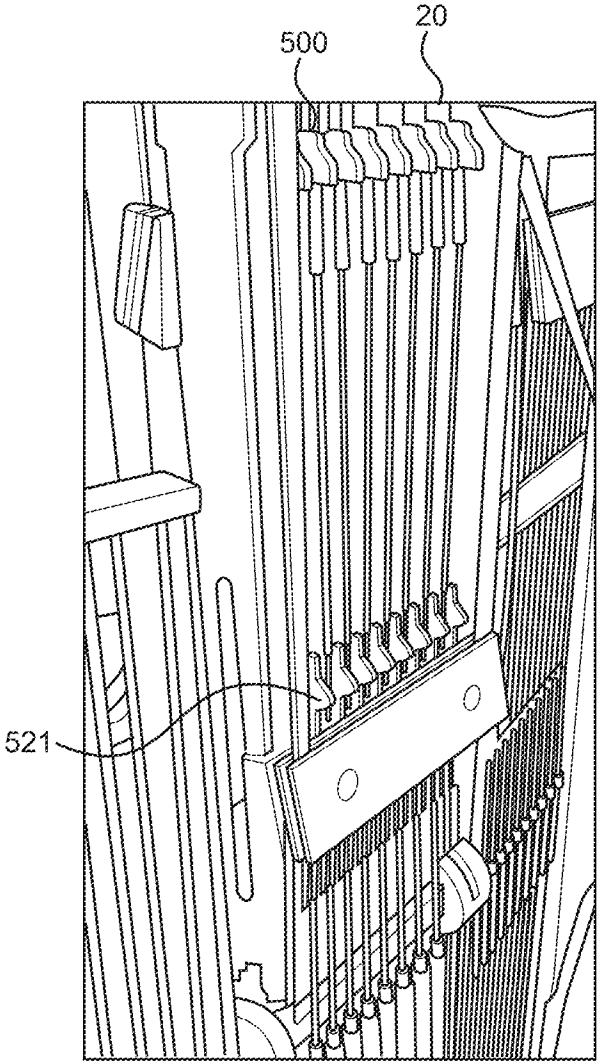

On a standard circular loom, heddle units are mechanically coupled to the motion of a main core rotor and the shuttles via a cam track and lever arms. Individual heddle control is known in a linear loom, see US Patent Application Publication No 2020/0048799, incorporated herein by reference. In circular loom 10, heddle units 20 (FIG. 1) are not mechanically connected to the main core. Rotation of the main core of loom 10 triggers heddle transitions but not with a cam system. Instead, as best seen in FIGS. 14 and 15, an array of hall effect sensors 510 are electronically connected to heddle units 20. FIG. 13 shows a perspective view of loom 10 under shuttles 15, while FIG. 14 is a perspective view of hall array sensors 510. As seen in FIGS. 15 and 16, showing a close-up view of heddle unit 20, each heddle 500 has two operational states: high or low. Hall effect sensor 510, acts as a synchronization sensor and triggers a heddle transition from high to low as shuttle 15 passes by sensor 510. As shuttle 15 passes sensor 510, it automatically triggers the pusher block 520 which travels between the high and low positions. A shuttle pusher arm 511 has a magnet 512 mounted thereon such that sensor 510 senses the passing of magnet 512. Heddle transitions from low to high of the respective heddle 500 are also controlled by heddle control board 522 which may be a separate controller or be part of controller 70.

As best seen in FIGS. 1, 15 and 16, each heddle unit has a belt driven pusher block 520 that travels between high and low positions. The block 520 moves groups of individual Jacquard hooks/fingers 521 between high and low positions. When moving in the upward direction, the Jacquard hooks/fingers 521 are pushed by pusher block 520. When moving in the downward direction, the Jacquard hooks/fingers 521 are pulled down by individual springs attached to heddle eyelets. At the top of the travel, the Jacquard hooks/fingers 521 are selectively locked/released by an electromagnetic latching mechanism. Heddle control board 522 determines which Jacquard hooks 521 are selectively locked or released, with the selection corresponding to any arbitrary weave pattern. The details of the latching mechanism are described in more detail in U.S. Pat. No. 5,839,481, incorporated herein by reference. Each of the Jacquard hooks 521 is correspondingly connected to a heddle eyelet which controls the position of the warp lines. Referring to FIG. 1, the pusher block motion is driven by a brushless DC motor 550 attached to a timing belt loop 560. Alternatively, the belt may be replaced with a mechanical linkage such as a crank rocker, cam linkage, or the like. The position of the pusher block is controlled via a geared encoder 570 attached to the main drive shaft. Alternatively, the position of the pusher block may be sensed directly.

Figure 11:
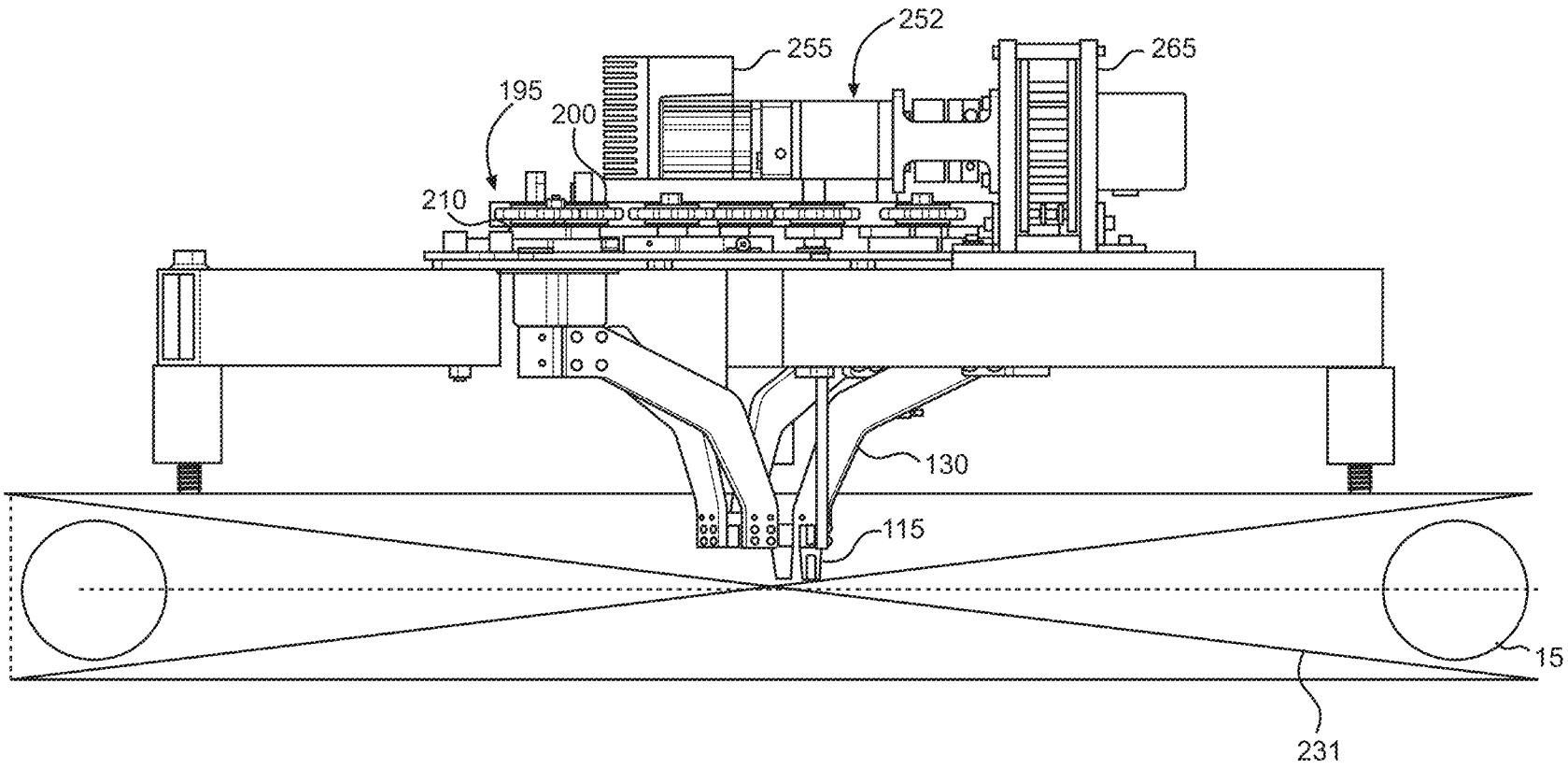
FIG. 11 shows two shuttles passing through the warp shed and the arms for supporting the weaving ring.

The Jacquard mechanisms are integrated into heddle units 20. Each of heddle units 20 has an individual drive motor 550 and is therefore modular. Heddle units 20 may be placed in a variety of positions on the loom and replaced as needed. Preferably thirty-six individual units are mounted in loom 10. Each heddle unit preferably has at least 18 functional heddles 500 and each warp line is routed through a single heddle eyelet, allowing heddle unit 20 to control opening and closing of warp shed 231 (FIG. 11). While weaving, heddle units 20 open sequentially to open shed 231 as shuttles 15 pass through shed 231. This arrangement provides control of over seven hundred twenty warp lines. Other arrangements allow for greater numbers of heddles 500, either by increasing the number of heddle units 20, or the number of heddles per heddle unit. In certain weaves more than one warp line can be routed through a single heddle eyelet.

This arrangement allows for the opening and closing of shed profile 231 separately from the motion of shuttles 15. As such the weave pattern in fabric product 100 can be varied. Loom 10 can weave patterns where multiple weft passes are made during a single warp shed opening, such as a basket weave. Common twill weaves can also be accomplished, including 2×1, 3×1, and 4×2 weaves. Certain twill weaves have reduced weft crossings and changing between these twill patterns allows for controlling the effective circumference of the fabric.

Figure 19:
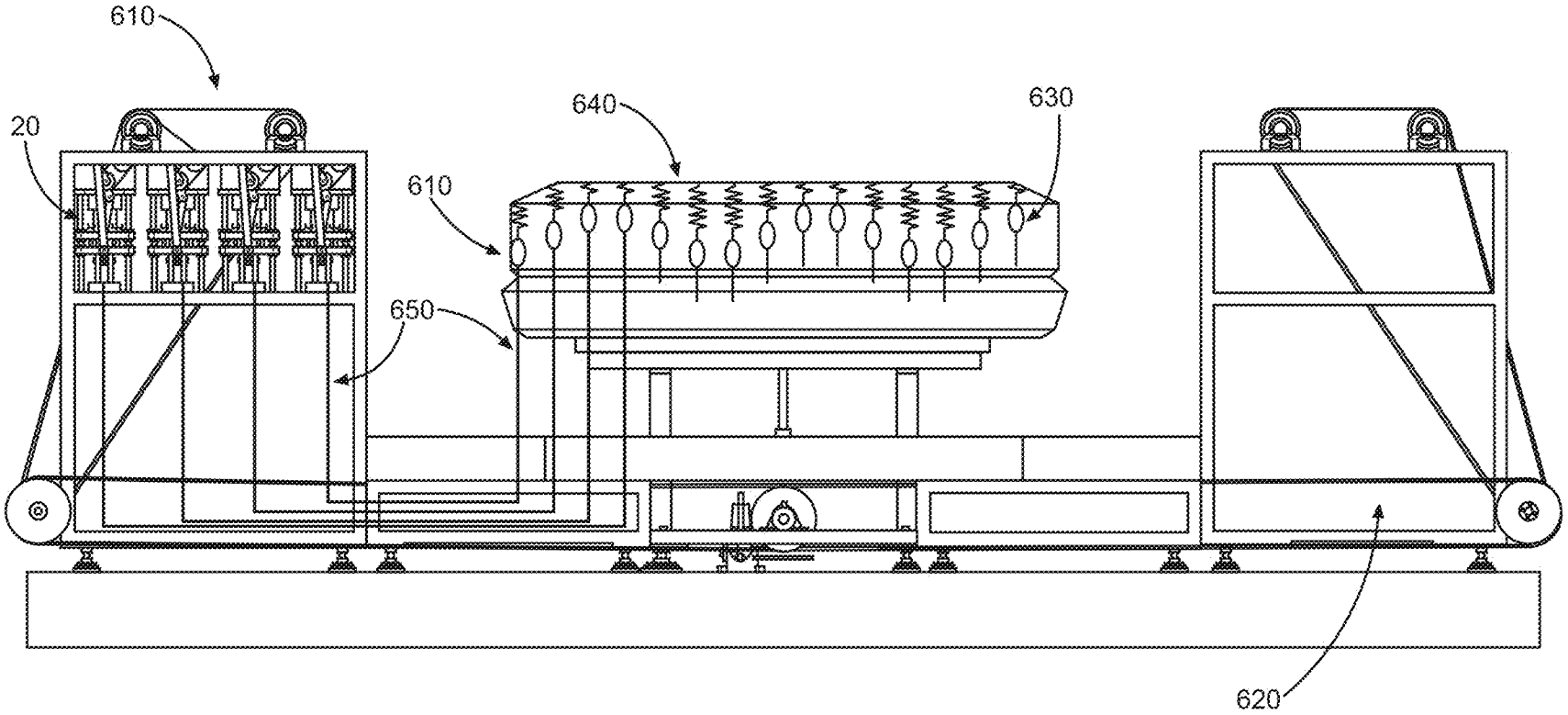
FIG. 19 is a side view an alternative arrangement of the heddle units.

In an alternative embodiment shown in FIG. 19, heddle units 20 are not physically co-located with the main core of circular loom 10 and are instead arranged at some distance from the core. Heddle units 20 may be arranged in groups, such that mechanical couplings and transmission elements can be shared between the units. Groups of heddle units 20 are known as a heddle bank 610. Each heddle unit 20 may still maintain a unique shed motion but is mechanically indexed relative to its neighboring heddle unit within the heddle bank 610. While weaving, the mechanical indexing allows heddle units 20 to open sequentially, generating a sinusoidal shed pattern in the loom core. When viewed from the side, as in FIG. 19, the resulting heddle eyelet positions will resemble a sine wave. The sine wave travels with the angular motion of each shuttle, wherein each shuttle is captured in an open shed.

In this embodiment, the heddle units 20 may be mechanically coupled to the motion of the main core with mechanical transmission 620. The heddle units 20 may optionally be electronically coupled to the motion of the main core, using synchronization methods previously described, or using other means known in the art such as encoders. In either approach, the individually actuated heddles are still electronically synchronized with the motion of the main core, the weaving ring, and the shuttles, thus allowing varying weave patterns to be created.

As best seen in FIG. 19, the heddle eyelets 630 and springs 640 are still co-located with the main core of circular loom 10. The eyelets 630 are mechanically coupled to the Jacquard hooks 521 by means of Jacquard cord 650. Jacquard cord 650 can be routed in a variety of arrangements, allowing for the large mechanical components of heddle units 20 to be mounted remotely from the main core of circular loom 10, thus improving operator access to the weaving area of loom 10. As such, additional heddles or heddle units 20 can easily be added.

During operation, with general reference to the figures described above, when fabric 100 is to be woven, master controller 70 determines an angular position for support arms 130 based on a desired diameter of variable diameter weaving ring 45. If the diameter of weaving ring 45 is to be reduced, take up winder 252 will wind up excess band material 190 until a target position value is detected by the joint encoder 230 on support arms 130. Conversely if the diameter of weaving ring 45 is increasing, take-up winder 252 will let out excess band material 190 while chain drive 195 moves support arms 130 to a desired position. Adjustments to the weaving ring diameter are made dynamically while weaving, based on a desired output set by control system 70. Weft shuttles 15 are powered by a main motor (not separately shown) on loom 10 to move shuttles 15 along a guiding track (also not shown). Each weft shuttle 15 deposits weft yarn 85 near variable diameter weaving ring 45 from weft bobbin 280 on shuttle 15. Heddle units 20 transition before and after weft shuttle 15 has passed. Weft shuttle 15 is encapsulated within warp shed 231 as best seen in FIG. 11. The transitioning warp yarns 80 capture the deposited weft yarns 85 to create the structure of the weave, namely fabric product 100 as shown in FIG. 3.

In order to create woven fabric product 100, the weave patterns of heddle units 20, diameter of weaving ring 45, and position of shuttle weft insertion arm 50, must all vary in a synchronized fashion. To accomplish this, a counter-based approach may be employed. In this paradigm, heddle units 20, weaving ring 45, and weft shuttle 15 are all equipped with separate control boards, which taken together with loom controller 70, comprise a distributed control system. Loom controller 70 sends separate weave instructions to heddle unit control board 522, weaving ring control board 253, and shuttle control board 325, where the instructions are then performed locally in response to the synchronization control signal 71. This allows each device to maintain a synchronized count reflecting the number of times synchronization control signal 71 has been received, thus ensuring that all devices are performing their desired actions in coordination. The weave instructions may be configured such that desired actions are only performed at specified count values. The weave instructions may be created in advance, in accordance with desired properties of woven fabric product 100 or set directly by an operator while weaving.

Figure 17:
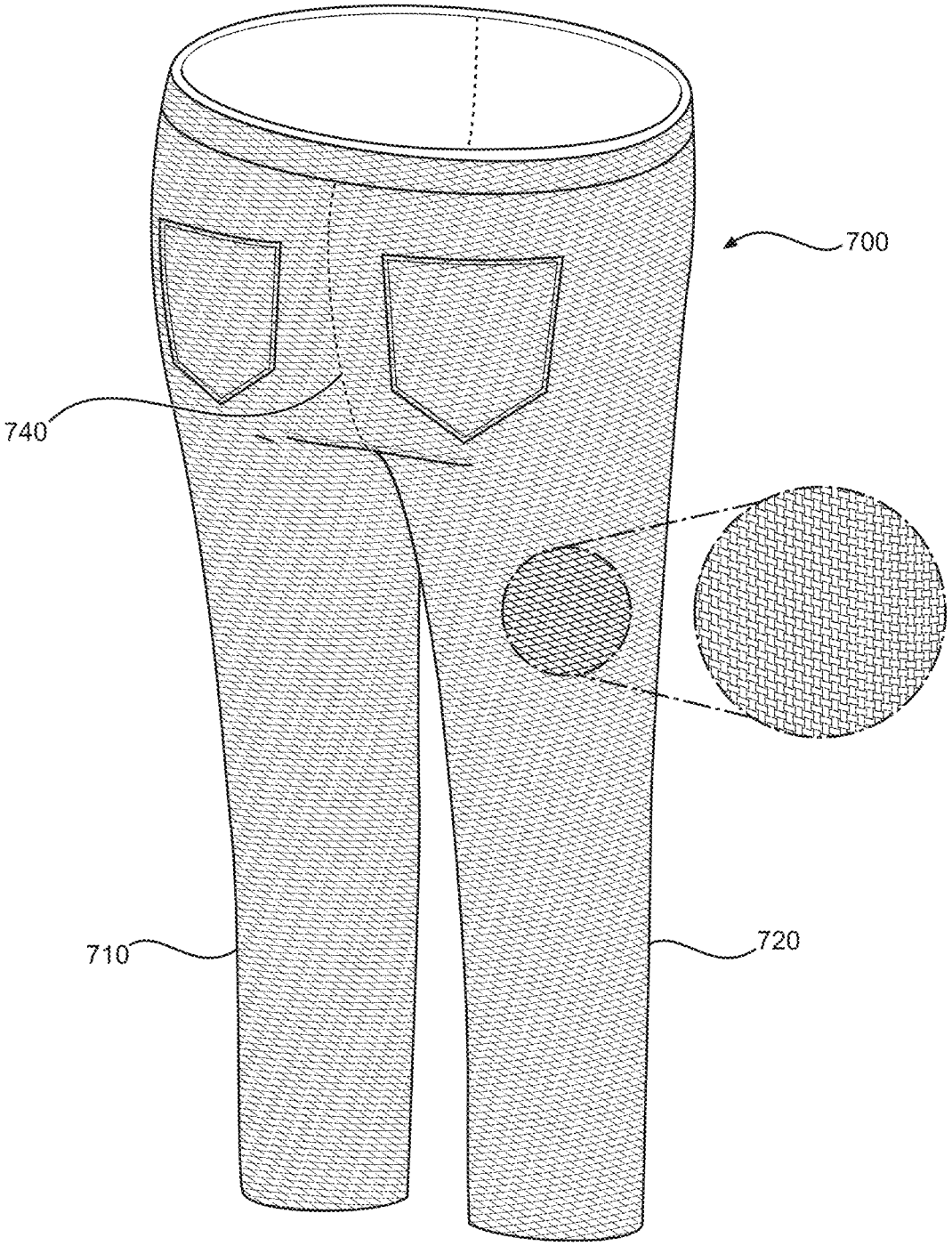
FIG. 17 shows a pair of pants made by the loom of FIG. 1.

The product 100 may be attached to other sections of weave to form a garment 700 as best seen in FIG. 17. Garment 700 may have first and second legs 710, 720 stitched together at a seam 740 to form the overall garment 700, such as a pair of trousers. Each leg 710, 720 of garment 700 is preferably formed with no seams.

As noted above, the previously employed circular looms are designed to weave at a fixed output size which creates a fabric shape with a constant diameter. Such looms can be reconfigured to weave at different diameters, but several components of the loom would have to be replaced and the loom would have to be rethreaded to make such a change in diameter. Due to this constraint, such looms cannot continuously weave fabric with varying diameter. Based on the above it should be readily apparent that the subject loom, having a variable diameter weaving ring and independently actuated heddles, is able to continuously weave fabric whose diameter varies along the length of the fabric as it is produced.

Various other changes may be made in the final product. For example, the output fabric density also dictates both the final size and quality of woven fabric product and can be changed in the preferred embodiments described above. Fabric density is defined in the textile industry as Ends Per Inch ("EPI") and is a count of the number of warp lines per inch of fabric. To maintain fabric appearance and quality, EPI of the output fabric must be kept quasi-constant across all weaving diameters; this is accomplished via thread manipulation methods such as thread packing or thread dropping. Because the above-described methodologies involve individual control of warp lines, independently actuated heddles must be utilized such as those described above. In thread packing, multiple adjacent lines will move in tandem, effectively behaving as a single line while they are included into the weave. In thread dropping, lines are selectively left out of the weave and are later trimmed from the output fabric. Varying weave patterns between common twill configurations, such as 2×1, 3×1, and 4×2 can also be used to reduce the number of weft crossings for an intended weave diameter, thus reducing the effective woven circumference of the fabric.

With the construction and operation detailed above, the circular loom of the invention can directly weave components of garments such as single pant legs, shirt sleeves, dresses etc. Complete garments can be advantageously, directly woven on demand.

The invention claimed is:

1. A circular loom for continuously weaving fabric with varying diameter, the loom comprising;

a variable diameter weaving ring;

a set of independently actuated heddles each configured to control a shed of a warp line;

at least one shuttle including a weft insertion arm, wherein the weft insertion arm is configured to adjust with a changing diameter of the weaving ring; and a control system for controlling actions of the weft insertion arm, the set of independently actuated heddles, the weaving ring, and the at least one shuttle in response to the changing diameter of the weaving ring, wherein the control system electronically synchronizes the actions of the heddles, the weaving ring, and the at least one shuttle.

2. The circular loom of claim 1, further comprising a rail for supporting the weft insertion arm and an actuator to linearly adjust the weft insertion arm along the rail.

3. The circular loom of claim 1, further comprising an array of magnetic sensors employed in synchronizing the actions the heddles, the weaving ring, and the at least one shuttle.

4. The circular loom of claim 1, wherein the control system is configured to establish the actions of the heddles, weaving ring, and the at least one shuttle based on weave instructions created in accordance with desired properties of a woven fabric product.

5. The circular loom of claim 1, wherein the control system includes at least two of a master loom control board, a heddle control board, a shuttle control board, and a weaving ring control board.

6. The circular loom of claim 1, further comprising two support arms mounted for synchronous motion, wherein each support arm includes a pivotable mounted guide configured to slidably support the variable diameter weaving ring.

7. The circular loom of claim 6, wherein each guide includes multiple fingers or rollers configured to support the variable diameter weaving ring.

8. The circular loom of claim 6, wherein the variable diameter weaving ring is made of a flexible band.

9. The circular loom of claim 8, further comprising a take-up mechanism and wherein a portion of the flexible band is placed in a circle to form the variable diameter weaving ring and a portion of the flexible band is stored on the take up mechanism, whereby the diameter of the weaving ring is increased by moving the support arms and some of the flexible band from the take up mechanism.

10. The circular loom of claim 1, wherein the at least one shuttle includes a sensor for detecting weft breakage.

11. The circular loom of claim 1, wherein the control system is configured to dynamically adjust the diameter of the variable diameter weaving ring based on a desired output.

12. The circular loom of claim 11, wherein the control system is configured to communicate with at least one shuttle to control a weft insertion point based on the diameter of the weaving ring.

13. The circular loom of claim 12, wherein the control system is configured to communicate with the set of independently actuated heddles to control shedding of the warp lines to achieve a desired weave pattern.

14. A method for continuously weaving fabric with varying diameter with a circular loom including a weaving ring, a set of heddles and at least one shuttle said method comprising:

varying a diameter of the weaving ring;

independently actuating the set of heddles to control a shed of a warp line;

adjusting a position of a weft insertion arm for the at least one shuttle with a changing diameter of the weaving ring;

controlling actions of the weft insertion arm, the set of heddles, the weaving ring, and the at least one shuttle in response to the changing diameter of the weaving ring; and electronically synchronizing the actions of the heddles, the weaving ring and the at least one shuttle.

15. The method according to claim 14, wherein the circular loom includes a rail for supporting the weft insertion arm, said method further comprising controlling an actuator to adjust the weft insertion arm along the rail.

16. The method according to claim 15, further comprising adjusting a position of the weft insertion arm with an actuator to linearly move the weft insertion arm along the rail.

17. The method according to claim 14, further comprising electronically synchronizing the actions of the heddles, the weaving ring, and the at least one shuttle based on instructions created in accordance with desired properties of a woven fabric product.

18. The method according to claim 14, wherein the loom includes two support arms, wherein varying the diameter of the weaving ring includes moving the support arms in a synchronous manner.

19. The method according to claim 18, wherein loom includes a take-up mechanism, the weaving ring is made of a flexible band and a portion of the band is mounted on the take-up mechanism, and wherein varying the diameter of the weaving ring further comprises increasing the diameter of the weaving ring by moving the support arms away from a center of the weaving ring and moving a portion of the flexible band from the take-up mechanism.

20. The method according to claim 14, further comprising actuating each said heddle with an individual actuator located on a respective said heddle.

21. The method according to claim 14, wherein the at least one shuttle includes a sensor, and the method further comprises detecting weft breakage with the sensor.

22. The method according to claim 14, further comprising dynamically adjusting the diameter of the weaving ring based on a desired output and controlling a weft insertion point based on the diameter of the weaving ring.

23. The method according to claim 22, further comprising communicating with the set of independently actuated heddles to control shedding of the warp lines to achieve a desired weave pattern.

* * * * *